United States Patent [19]

Dieudonne et al.

[11] Patent Number: 4,574,422

[45] Date of Patent: Mar. 11, 1986

[54] RESILIENTLY BIASED SHOES FOR MAINTAINING A VEHICLE DOOR IN AN OPEN POSITION

[75] Inventors: Jean P. Dieudonne, Fresse Sur Moselle; Michel Steiner, Remiremont, both of France

[73] Assignee: Compagnie Industrielle de Mecanismes, France

[21] Appl. No.: 637,997

[22] Filed: Aug. 6, 1984

[51] Int. Cl.[4] ..... E05F 5/08

[52] U.S. Cl. ..... 16/85; 16/DIG. 36; 188/166

[58] Field of Search ..... 16/82, 85, 327, 332, 16/352, 363, 364, DIG. 36; 188/166, 167; 267/174

[56] References Cited

U.S. PATENT DOCUMENTS 1,869,316 7/1932 Robertson ..... 16/82

2,915,778 12/1959 De Vito ..... 16/82

2,939,166 6/1960 Allen ..... 16/82

FOREIGN PATENT DOCUMENTS 778581 7/1957 United Kingdom ..... 16/85

*Primary Examiner*—Fred Silverberg

[57] ABSTRACT

A mechanical device for maintaining a door in an open position, having an arm slidable in a guide body provided with shoes capable of spreading apart upon the passage of the arm, and springs having a resilient opposing action tending to move the shoes towards each other. According to the invention, the guide body has at least one surface element having a cylindrical outer shape, mechanically connected to the shoes and radially deformable. An opposing action is formed by at least one coil spring which is mounted coaxially around and in contact with the surface element. A preferred application of the device is for doors of motor vehicles.

10 Claims, 5 Drawing Figures

RESILIENTLY BIASED SHOES FOR MAINTAINING A VEHICLE DOOR IN AN OPEN POSITION

FIELD OF THE INVENTION

The present invention relates to a mechanical device for maintaining a door in the open position.

The invention is in particular applicable to motor vehicle doors.

In order to render the following description more clear, only this application will be considered, it being understood that it concerns a preferred example which is in no way intended to be limitative.

DESCRIPTION OF THE PRIOR ART

The devices of the considered type, which mostly also serve to limit the angle of opening, essentially comprise an arm pivotally mounted at one end on the lateral post of the frame where the door hinge is located. The arm, which is left free at its other end, is slidable in a guide which is fixed in the edge of the door and faces the end of the arm attached to the frame.

This functional arrangement, which is the most often adopted, however does not of course exclude the possibility of reversing the assembly, the guide being then fixed to the frame and the arm pivotally mounted on the opening part of the door.

The guide constitutes a more or less complex mechanical assembly depending on the various proposed technologies, but usually has in one way or another two shoes (also termed rollers) placed in facing relation at a short distance from each other so as to define therebetween a space for the passage of the arm. Means having an opposing action are provided for spreading in a resilient manner the shoes under the action of an exterior force.

Most often, these means comprise a return spring system which ensures the mobility of at least one shoe, the spring being for example of the torsion type acting under compression or traction, or of the bending type, such as a spiral or helical spring having prolonged ends.

The force for separating the shoes is transmitted, in the course of the movement of the door, by the arm itself which has for this purpose on at least one surface facing the shoes, spreading elements which are usually thickened parts, such as bosses or any other like arrangement constituting an obstacle which the shoes must pass through.

These thickened parts which have an asymmetric profile, define a ramp the rise of which causes, in the course of the opening of the door, a progressive spreading apart of the shoes, this ramp being followed by a locking step in which is disposed a shoe so as to maintain the door in the open position.

Inversely, in the course of the closure of the door, after a sufficient initial effort to enable the shoe to pass over the locking step, the path along the ramp in the descending slope direction assists the closure of the door.

Such devices have been widely known for a long time and descriptions of various models may be found in many patents filed on this subject, for example in the French patent applications No. 2 280 778 and 2 284 740 (PAUMELLERIE ELECTRIQUE), No. 2 124 915 (DAIMLER) or the French Pat. No. 1 601 092 (ED. SCHARWACHTER KG) and the U.S. Pat. No. 2,860,369 (GALLA).

As can be observed, all these known devices are relatively complex in their design and construction, which has an adverse effect on the manufacturing cost.

Further, these devices are intended to be highly stressed, and experience has shown statistically a limited reliability resulting in their replacement often well before the high numbers of working cycles required by the clients and in particular by automobile constructors, have been reached (60,000 and even more opening-closing cycles).

SUMMARY OF THE INVENTION

An object of the present invention is to provide a simple and cheap arrangement which is highly reliable over a period of time.

The invention therefore provides a mechanical device for maintaining a door, and in particular a motor vehicle door, in the open position, said device comprising an arm slidable in a guide having two shoes placed in facing relation and at a short distance from each other so as to define therebetween a space for the passage of the arm, the latter being provided on at least one of its sides facing the shoes with means for spreading apart said shoes, means having a resilient opposing action being provided in the guide for opposing the spreading apart of the shoes by the slidable arm, wherein the guide has at least one support surface element having a cylindrical outer shape and mechanically connected to the shoes and radially deformable by expansion and contraction respectively when the shoes are spread apart and moved towards each other, and the means having a resilient opposing action are formed by at least one coil spring coaxially mounted around and in contact with said support surface element.

In a preferred embodiment, the support surface element of the spring and the shoes constitutes a body in one piece.

Advantageously, this body is a hollow cylinder through which extend in a perpendicular direction the arm in its median part and is equipped with a spring at each of its end parts, the axis of the spring being colinear with the longitudinal axis of the body. Preferably, the shoes are placed inside the cylinder.

According to a preferred modification, the coils of the spring or springs have their inner surface in contact with the support surface of planar shape so as to achieve a maximum area of contact with the support surface element.

Advantageously, the coils have a quadrangular section such as a square or rectangular section.

As will have no doubt been understood, the invention resides, in its basic features, in causing a spring of the helical type to operate by swelling, in other words in an "anti-mechanical" manner totally foreign to the specific normal modes of deformation of this type of spring.

This simple basic arrangement, which may at first sight be surprising owing to the fact that it is the opposite, if not the opposing practice relative to the conventional use of this type of spring, directly underlines the conception of the mechanism according to the invention which has many advantages over the known mechanisms, both from the point of view of manufacture and from the point of view of its utilization.

In this respect, there may be in particular mentioned a low manufacturing cost, a relatively simple tooling and a great facility of assembly of the component elements.

Further, there has been found in use a very low rate of fatigue of the moving parts, and in particular the springs, and a high constancy over a period of time of the quality of the results.

BRIEF DESCRIPTION OF THE DRAWINGS

The invention will be understood and other aspects and advantages will appear more clearly from the following description with reference to the accompanying drawing, in which.

DETAILED DESCRIPTION OF THE PREFERRED EMBODIMENTS

In the Figures, the same elements are designated by identical references.

Figure 2:
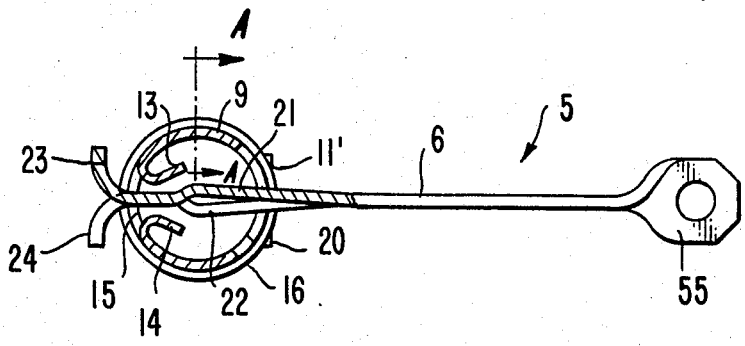
FIG. 2 is a median longitudinal sectional view of the mechanism.
Figure 3:
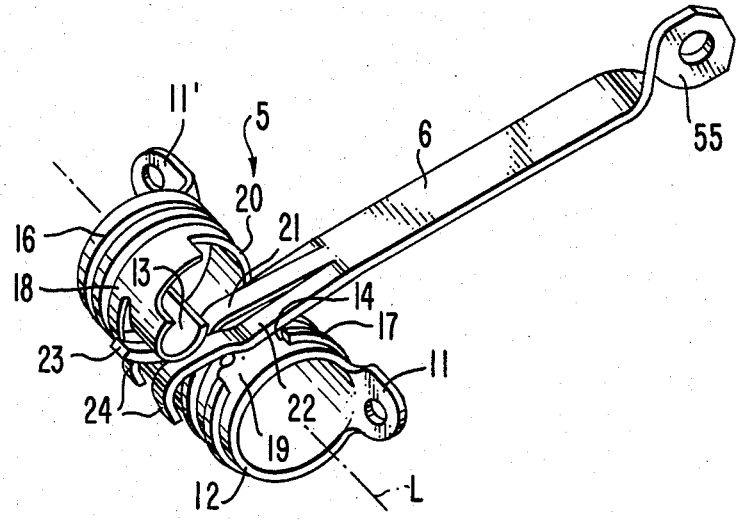
FIG. 3 is a perspective view of the top of the mechanism with a part cut away.
Figure 4:
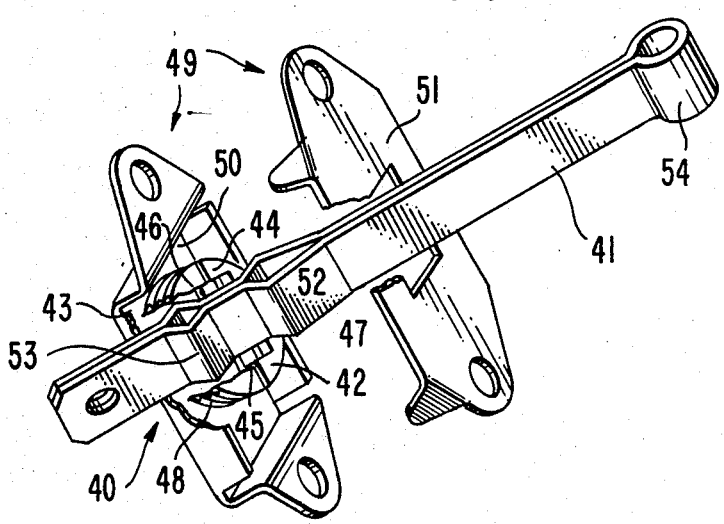
FIG. 4 is a perspective view of a modification of the mechanism, with a part cut away.
Figure 5:
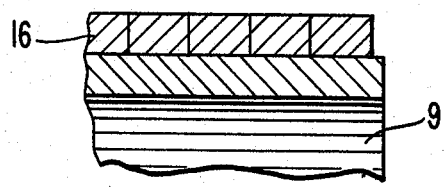
FIG. 5 is a partial sectional view taken along line A—A in FIG. 2.

Further, it may be considered that FIGS. 2, 3 and 4 represent mechanisms according to the invention in their actual size.

Figure 1:
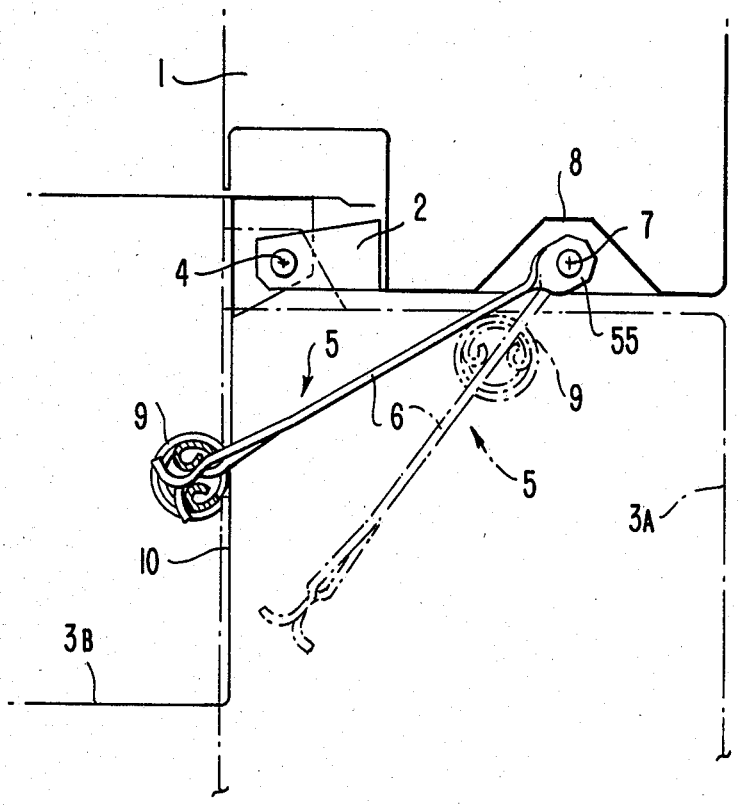
FIG. 1 is a diagram representing the top view of a motor vehicle door equipped with the mechanism according to the invention.

FIG. 1 shows at 1 the lateral post of the frame of the door, in the recess of which is mounted a fork 2 for hinging the door. The latter has been shown in the closed position 3A, in dotted lines, and in the open position 3B, swung outwardly of the vehicle, in full lines. The vertical hinge axis has been symbolically shown at 4.

As can be seen, the device 5 according to the invention comprises an arm 6 formed of a flat metal rod and pivotally mounted at one of its ends on a pin 7 parallel to the hinge axis 4 of the door, and disposed in a cavity 8 in the post 1. This arm is left free at its other end and slides in a guide body 9 which is fixed to the inner surface of the pillar 10 of the door in alignment with the cavity 8 when the door is closed.

In order to avoid unnecessarily complicating the Figure, only the references relating to the guide 9 shown in the door in the open position 3B have been indicated.

With reference now also to FIGS. 2 and 3, it can be seen that the guide body 9 is a hollow cylindrical body having a longitudinal axis L and provided at each end with an ear 11, 11' for fixing it to the door.

In the illustrated embodiment, the body 9 is a rolled sheet metal part having non-connected edges so as to define a longitudinal slot 12 allowing a radial deformation of the element.

Further, in the median part of the body, there are provided two shoes 13, 14 formed by an inward folding of edge tabs which were initially provided for this purpose when the metal sheet was cut out before rolling.

These shoes are placed in facing relation and at a short distance from each other so as to define therebetween a space 15 for the passage of the arm 6.

Further, two coil springs 16, 17, having an inside diameter equal to the outside diameter of the body 9, are respectively mounted on each end portion 18, 19 of the latter on each side of the shoes.

An assembly is achieved in this way in which the springs axes are colinear with the axis L of the body 9.

The similar shape of the springs and the body, in combination with the coincidence of their respective diameters, ensure that the springs bear perfectly against their support surface elements formed by the end portions 18 and 19.

An opening 20 is formed in the median part of the body 9 in a position diametrically opposed to that of the space 15 between the shoes, so as to define with this space a passageway for the passage of the slidable arm 6.

Thus the arm 6 passes through the body 9 in its median part in a direction perpendicular to the longitudinal axis L of the body.

As can be seen in the Figures, the arm 6 includes on its large sides, facing the shoes of the body 9, opposed bosses 21 and 22 having apices spaced apart a distance which is slightly greater than the nominal distance between the shoes.

In the described embodiment, the bosses 21, 22, localized in the vicinity of the free end of the arm, are produced simply by a cold deforming operation which is usually termed a "bursting" operation and which roughly comprises, after cutting, press-forming the central part and the two edge parts in opposite directions.

Bosses are thus formed which constitute ramps having an asymmetric longitudinal profile having in the direction from the anchoring end 55 of the arm to its free end, a slight upward slope followed, after the apex of the boss, by a steep downward slope forming a locking step or notch in which a shoe is engaged and thus maintains the door in the open position.

Thus the function of maintaining the door in the open position is achieved when the arm 6 moves, upon opening the door, in the body 9: the bosses 21, 22 of the arm spread apart the shoes 13, 14 which re-transmit this movement to the whole of the body 9 which tends to be unrolled with a widening of the slot 12, which causes the springs 16 and 17 to expand.

After passage over the tops of the bosses, the reverse procedure occurs: the opposing action of the springs tends to re-close the body 9 which contracts radially and thus causes the shoes 13, 14 to move toward each other as they travel along the descending slope.

When the shoes reach the base of the bosses, the maintenance of the door in the open positon 3B is ensured owing to the steep front that the boss present to the shoes in the direction for closing the door.

Further, according to an advantageous modification, a fold may be provided adjacent the end of the arm 6 so as to form cranked end portions 23, 24 which constitute stop abutments for the shoes and consequently limit the angle of opening of the door.

As will have been understood, the invention resides therefore essentially in causing a coil spring to expand by an unwinding of the coils under the effect of the spreading of the shoes.

Apart from the unwinding forces due to the springs themselves, the contact between the body 9 and the springs produces frictional forces which oppose the relative displacement of the parts concerned.

The frictional forces F are of the type $F=T(e^{c\theta}-1)$, in which T corresponds to the force for the unwinding of about a semi-revolution of the springs, c is the coefficient of friction between the spring and the body and $\theta$ is the winding angle of the spring, ($\theta$ has therefore the magnitude in radians $2\pi N$ in which N is the number of coils of the spring).

It can be immediately seen that when the number of coils increases, the frictional forces become very quickly preponderant relative to the forces for unwinding the spring (bending force). This enables the production in the region of the shoes of large forces with springs of very small dimension, since only the coiling angle $\theta$ varies the shoe spreading force.

Further, if it is desired to maintain a minimum number of coils for a given spreading force, it is of interest to render the coefficient of friction as large as possible, which can be assumed by springs with flat or planar coils, at least on their inner surface in contact with the body (more simply, coils having square or rectangular coils) and/or springs having adjoining coils.

In the foregoing embodiment, a preferred embodiment of the invention has been described in which the springs can be mounted through the medium of their supporting body, in such manner that their axis is perpendicular to the axis of the arm 6.

It will be understood that other variations may be envisaged, for example the springs can be mounted to be curvilinear with the arm.

One of these variations is illustrated in FIG. 4.

In this embodiment, the body 40 for guiding the slidable arm 41 is a short cylinder which is this time coaxial with the arm and comprises two semi-moon members 42, 43 which are applied against each other by their base so as to define therebetween a gap or slot 44 whose function is similar to the previously-described slot 12.

The central part of the body 40 is hollowed out so as to define a passage 45 for the arm, the lips of this passage being formed by beadings constituting the shoes.

Two shoes 46 and 47, similar to the shoes 13, 14, mentioned before, are thus formed within the thickness of each member 42 and 43 in the middle part of the base of the latter.

The cohesion of the assembly of the semi-moon members is ensured by a coil spring 48 which is placed around and in contact with the outer surface of the members 42 and 43.

The whole is disposed in a protective case 49 comprising a main container 50 and a closing plate 51 having flaps, the container and the plate being provided with ears for placing in position means for fixing it to the door.

Further, in this embodiment, the bosses 52 of the arm and the abutment 53 limiting the angle of opening of the door, are constructed, as can be seen, from an arm in two portions folded one against the other and forming, at one end, a ring 54 for receiving the pivot pin.

It will be understood that the principle of operation of such a device is exactly the same as that explained before.

The sole notable difference resides in the fact that the embodiment shown in FIGS. 2 and 3 requires a smaller number of component parts to be assembled than that just described.

Further, from the more functional point of view, it may also be mentioned that the embodiment shown in FIG. 4 affords less possibilities than that previously described as concerns the length of the spring, and therefore the angle of coiling, although such a disadvantage may be overcome without too much difficulty.

For example, a body 50 may be made slightly in the shape of a diabolo, i.e. having the required outside length for receiving the spring but a thickness reduced from the periphery to its central part so as to avoid the functional drawback of excessively large shoes.

Whatever be the chosen embodiment, the device according to the invention has many advantages over known devices at present commercially available.

Some of these advantages concerning the manufacture and the utilization have already been mentioned before.

Further advantages may be stressed among which may be mentioned, for example:

the fact that the whole of the device is entirely in metal renders it practically insensitive to variations of temperature and to differential expansion effects between the assembled component parts;

great facility of assembly of these parts even in respect of the less compact embodiment illustrated in FIG. 4;

great flexibility and smoothness of operation which in particular results in an absence of unpleasant noises both when opening and closing the door;

the fact that the whole of the device is of the modular type renders it perfectly adaptable to any type of door; in particular, the arm may be easily adapted to many types of vehicles by a simple variation in its length or in the arrangement of the bosses; further, for a given vehicle, the choice of an arm length or of the arrangement of the bosses permits the adjustment of the angle of opening of the door to a required value;

great constancy over a period of time of the results obtained and the perfect reproducibility of the performances from one device to another.

It will be understood that there is no intention to limit the scope of the invention to the described embodiments since this scope defined in the appended claims embraces many modifications or equivalents.

For example, in the case of the embodiment described with reference to FIGS. 2 and 3, the guide body 9 carrying the springs oriented to be perpendicular to the slidable arm, may be constructed by a coiling of an ordinary commercially available steel sheet which is thereafter subjected to a surface carbonitriding treatment, so as to impart thereto the desirable mechanical properties for operation without fatigue due to repeated bending of a small amplitude to which it must be subjected.

Further, the force required to unblock the door so as to close it may be adjusted by adjusting the curvature of the shoes in such manner as to obtain an adequat engaging angle of the latter against the steep front of the bosses.

In this way, it is possible to adjust the locking force in the open position in a manner practically independent of the force desired for spreading apart the shoes when opening the door, which is only a function of the characteristics of the springs and their cooperation with their support surface.

Again, the simplicity of the device according to the invention and its small overall size permit many possibilities of different placements.

Thus, the arrangement of the mechanism, such as shown in FIG. 1 in which the arm is in a vertical plane and consequently has an anchoring end 55 bent through 90° so as to be placed on its vertical pivot pin 7 is in no way limitative.

Indeed, it is perfectly possible to envisage placing the arm in a horizontal position, the guide body 9 being in this case fixed within the thickness of the door.

It is not essential to arrange that the arm slide along its large side in the guide body. Indeed, it can be envisaged to cause the arm to slide along its edge, in which case, of course, the bosses must be provided on the edges which will then be placed in facing relation to the shoes.

The bosses have only been mentioned here as particular means for spreading apart the shoes among many other possible means, without departing from the scope of the invention.

The arrangement of the shoes 13 and 14 inside the guide body 9 is in no way essential. Indeed, it is quite possible, without adversely affecting the essential qualities of the device, to arrange the folded portions of the coiled sheet forming the guide body so that they extend outwardly of the body, the essential point being of course to effect the two foldings in the same direction so as to obtain two shoes in confronting relation to each other.

It will be understood that it is not essential to arrange the arm in a flat shape or rectilinear shape, since any other arrangements in this respect may be suitable within limits that one skilled in the art would be able to determine in accordance with his requirements and desires.

What is claimed is:

1. A device for maintaining a door attached to a stationary structure in an open position comprising:

(a) an arm attached to the stationary structure and extending into the door;

(b) a pair of opposed shoes spaced so as to define a guide path for the arm therebetween, the shoes slidably contacting at least a portion of the arm, the distance between the shoes being less than the maximum thickness of the arm such that the shoes are spread apart and move toward each other as the arm passes along the guide path;

(c) a generally cylindrical, resilient support structure attached to each of the shoes, the support structure having a support surface and being resiliently deformable when the shoes are moved away from each other; and, (d) at least one coil spring disposed about the support structure such that the coils of the spring are in frictional contact with the support surface so as to exert a force thereon which opposes the spreading apart of the shoes.

2. The device according to claim 1 wherein the shoes are formed integrally with the support structure.

3. The device according to claim 2 wherein a longitudinal axis of the generally cylindrical support structure is oriented generally colinear with a longitudinal axis of the arm.

4. The device according to claim 1 wherein the generally cylindrical support structure has a longitudinal axis extending generally perpendicular to a longitudinal axis of the arm.

5. The device according to claim 4 wherein the support structure has an elongated cylindrical shape and defines an opening through a median portion aligned with the shoes to further define a guide path for the arm extending through the opening.

6. The device according to claim 5 further comprising a pair of coil springs disposed about the support structure and in frictional contact with the support surface, a coil spring being located on each side of the longitudinal axis of the arm.

7. The device according to claim 5 wherein the generally cylindrical support structure comprises a coiled metal sheet having an open portion extending parallel to a longitudinal axis of the cylinder.

8. The device according to claim 1 wherein the coils of the at least one coil spring each have a generally planar portion in frictional contact with the support surface.

9. The device according to claim 8 wherein each coil has a generally rectangular cross-sectional shape.

10. The device according to claim 1 wherein each of the coils of the at least one coil spring are in frictional contact with adjacent coils.

* * * * *